US011406204B2

(12) United States Patent
Siebuhr

(10) Patent No.: US 11,406,204 B2
(45) **Date of Patent: *Aug. 9, 2022**

(54) COMFORT AND SAFETY LINEN SYSTEM

(71) Applicant: Jason Siebuhr, San Diego, CA (US)

(72) Inventor: Jason Siebuhr, San Diego, CA (US)

( * ) Notice: Subject to any disclaimer, the term of this patent is extended or adjusted under 35 U.S.C. 154(b) by 105 days.

This patent is subject to a terminal disclaimer.

(21) Appl. No.: 16/548,117

(22) Filed: Aug. 22, 2019

(65) Prior Publication Data

US 2019/0374051 A1 Dec. 12, 2019

Related U.S. Application Data

(63) Continuation of application No. 16/093,350, filed as application No. PCT/US2018/018204 on Feb. 14, 2018, now Pat. No. 10,398,240.

(60) Provisional application No. 62/594,816, filed on Dec. 5, 2017, provisional application No. 62/504,896, filed on May 11, 2017, provisional application No. 62/459,896, filed on Feb. 16, 2017.

(51) Int. Cl.

| | |
|---|---|
| ***A47G 9/02*** | (2006.01) |
| ***A47C 21/02*** | (2006.01) |
| ***A47G 9/10*** | (2006.01) |

(52) U.S. Cl.

CPC ..... *A47G 9/0238* (2013.01); *A47C 21/022* (2013.01); *A47G 9/02* (2013.01); *A47G 9/0261* (2013.01); *A47G 9/1045* (2013.01)

(58) Field of Classification Search

CPC ..... A47G 9/02; A47G 9/0238; A47G 9/0246; A47G 9/0261; A47G 9/1045; A47C 21/022

See application file for complete search history.

(56) References Cited

U.S. PATENT DOCUMENTS

| | | | | |
|---|---|---|---|---|
| 4,563,785 | A * | 1/1986 | Samelson | A47G 9/10 112/475.08 |
| 5,628,077 | A * | 5/1997 | Briganti | A47G 9/0246 5/496 |
| 5,765,241 | A * | 6/1998 | Macdonald | A47G 9/0246 112/475.08 |
| 5,996,148 | A * | 12/1999 | McCain | A47C 31/105 5/497 |
| 9,510,698 | B1 * | 12/2016 | Krotova | A47G 9/02 |
| D778,638 | S | 2/2017 | Williams | |
| 10,398,240 | B2 * | 9/2019 | Siebuhr | A47G 9/1045 |
| 2008/0078029 | A1 * | 4/2008 | Seago | A47G 9/0246 5/499 |
| 2015/0305524 | A1 * | 10/2015 | Shilts | A47C 21/022 340/686.6 |

FOREIGN PATENT DOCUMENTS

| | | | | |
|---|---|---|---|---|
| WO | WO-9217097 | A2 * | 10/1992 | A47G 9/0246 |

* cited by examiner

*Primary Examiner* — David R Hare

(74) *Attorney, Agent, or Firm* — Wagenknecht IP Law Group PC

(57) ABSTRACT

Provided herein is a bed linen system formed from a one-piece panel that includes slits separating a bed sheet portion from a blanket portion and integral gussets that envelop the corners of a mattress. The slits work in conjunction with the gussets to redirect tension from pulling force applied to the blanket towards the center axis of the mattress, thereby making it more difficult to remove the system from the mattress by a user, while allowing the user to ventilate the foot area during use.

20 Claims, 15 Drawing Sheets

COMFORT AND SAFETY LINEN SYSTEM

CROSS REFERENCE TO RELATED APPLICATION(S)

This application is a continuation of U.S. Ser. No. 16/093,350, filed Oct. 12, 2018, which is a U.S. national phase application under 35 U.S.C. § 371 of international patent application no. PCT/US2018/018204, filed Feb. 14, 2018, which claims the benefit of priority under 35 U.S.C. § 119(e) of U.S. Ser. No. 62/459,896, filed Feb. 16, 2017, of U.S. Ser. No. 62/504,896, filed May 11, 2017, and of U.S. Ser. No. 62/594,816, filed Dec. 5, 2017, the entire content of each of which is incorporated herein by reference.

BACKGROUND OF THE INVENTION

Field of the Invention

The invention relates generally to bed linens and more specifically to a linen system constructed from a single piece of material for safety and comfort of the user.

Background Information

Every year more than 1500 suicides take place at inpatient hospital units throughout the United States, and of that number, more than 70% of self-harm attempts are as a result of asphyxiation by hanging. Over 50% of the time the five primary items utilized for such attempts are mattress covers, sheets, pillow cases, pillows and blankets. The reasons are obvious: they are easily accessible and they are easy to manipulate. Typical bed sheets and bedding can be torn or wrapped tightly, increasing the likelihood that a suicide attempt will be lethal. The Federal National Center for Patient Safety reports that ligatures made from sheets or bedding were used in over 50% of all hanging suicides at inpatient psychiatric units.

Practical application of a linen system must not only be safe for the particular concern addressed herein but must be practical and functional for the individuals involved. With regard to a patient who suffers from self-harming or suicidal behavior and thoughts, the primary concern is to avoid opportunity for which a self-harm device may be formed from a bed sheet, blanket and/or bed linen. The comfort and care of the patient is another concern where use of a safety linen system must require minimum effort in linen changes for patients who have difficulty with movement and/or are impaired. With regard to the caregiver and institution who manage the patient and the facility environment, the safety linen system should minimize expenses and effort by a caregiver for linen changes while maximizing benefit and ease of use to the caregiver and patient.

Previous attempts to address the problem have resulted in bed linen systems having at least one blanket portion and at least one mattress cover that may be difficult to remove from the mattress and/or are made of sufficiently thick materials that reduce the ability to form a self-harm device. In these previous attempts at addressing the problem, care has been taken when attaching the blanket portion to the mattress cover in an attempt to prevent a patient who suffers from self-harming or suicidal behavior and/or thoughts from disassembling the system. For example, multiple runs of stitching, hard plastic rivets, welds, adhesives, etc., have all been suggested as being used to securely attach the blanket to the mattress cover to form a union. However, the disadvantages associated with all of these known linen systems is that there exists a union or attachment point between the two separate units forming the blanket and mattress cover. As such, a determined patient who suffers from self-harming or suicidal behavior and/or thoughts is likely to focus his or her attention at the union in order to separate the units to form a self-harm device. Additionally, because a union or attachment point exists in each of these known bed linen systems, continued application of force (i.e., through regular use, washing, and/or attempted separation) will eventually cause the union to fail since the stitching perforates the material and creates a weak point.

Further attempts have been made to locate the union or attachment point at various locations, such as at the top or bottom edges of the mattress cover or beneath the mattress, to minimize the ability to separate the blanket from the mattress cover by a determined patient. However, application of enough force to the blanket (e.g., by pulling) will eventually cause the union to fail and/or may cause the mattress to bend or bow upward allowing the linen to release from the mattress. Likewise, attempts to prevent previous linen systems from being pulled away from the mattress have included providing portions of the bedsheet cover to be folded under the mattress. While such pockets enveloping substantial portions of the mattress may inhibit removal by the patient, the amount of effort required by a caregiver to replace the linens for cleanliness is unreasonably large. Further, continuous removal/replacement of such linens by caregivers causes excess stress and premature failure at stitched or bonded unions of various materials.

Therefore, there is a need to provide a true one-piece bed linen solution that is an attractive and safe alternative to the standard bed linens and sheets used in hospitals and institutions, and eliminates the need for an attachment point or union between the blanket and mattress cover, where the linen is not easily removed from a mattress by a patient, yet allows for easy removal by a caregiver for washing/changing. The present invention accomplishes these objectives.

SUMMARY OF THE INVENTION

The invention provides a bed linen system. The bed linen system includes a one-piece panel having a top side, a bottom side, and an axis. The one-piece panel includes a bed sheet portion configured to fit on a mattress, a pair of opposing slits, each of the slits extending from a side edge of the panel toward the axis, wherein the slits form a location where the panel is folded over itself when placed on the mattress, a plurality of gussets, each gusset being formed by folding at a bottom edge of the bed sheet portion of the panel and securely attaching a side to an adjacent edge of the bed sheet portion, wherein each gusset is configured to allow the bed sheet portion to envelop a corner of the mattress, and a blanket portion configured to cover the bed sheet portion and drape over side edges of the mattress when the panel is folded over itself. Thus, the slits are configured to separate the bed sheet portion from the blanket portion and direct tension toward the axis resulting in gripping of the mattress when the blanket portion is pulled in a direction away from the fold. In various embodiments, the slits are also configured to allow a user to fold the blanket portion toward the axis for ventilation during use In various embodiments, the gussets may be shaped to resemble a parabolic curve comprising a long edge and a short edge, and wherein the long edge is integral to the side edge of the panel and the short edge is securely attached to a headboard-side edge or a footboard-side edge of the bed sheet portion of the panel. In various embodiments, the short edge of each gusset has a length substantially equivalent to that of each slit. The bed linen system may further include a reinforcing strap fixedly attached to a corner of each gusset and extending along a side of the bed sheet portion and terminating at a lower portion of the blanket portion, wherein the reinforcing strap is configured to enhance the tension being directed toward the axis, thereby resulting in increased gripping of the mattress when the blanket portion is pulled in a direction away from the fold. In various embodiments, the bed linen system may also include a reinforcement fixedly attached to a second corner of each gusset, wherein the reinforced corners of each gusset form hinge points configured to facilitate removal of the linen system by a caregiver. In various embodiments, the reinforcing strap may also include a pair of extensions configured for attachment to a top side of the bed sheet portion. In various embodiments, the bed linen system may also include an end cap permanently attached to a footboard-side edge of the bed sheet portion of the panel.

In various embodiments, each of the reinforcing strap and reinforcement are made from a material independently selected from the group consisting of binding tape, gross grain, woven or non-woven material, nylon, cotton, cotton polyester blend, or any combination thereof. In various embodiments, the panel is made of a quilted material, such as a cotton polyester blend. In various embodiments, the bed sheet portion also includes one or more (i.e., 1, 2, 3, 4, 5, or more) flexible inserts disposed in each side and positioned to take up slack resulting from use of the system on an adjustable bed.

In certain embodiments, the bed sheet portion also includes an integrated pillow securely attached to the bottom side of the panel. The pillow includes a top layer, a bottom layer, and an underlayment, wherein the pillow is securely fastened to the panel by one or more stitches selected from the group consisting of bar-tack stitches, single stitches, double stitches, triple stitches, blind stitches, other stitches, and any combination thereof.

In another aspect, the invention provides a bed linen system. The bed linen system includes a one-piece panel having a top side, a bottom side and an axis. The one-piece panel includes a bed sheet portion configured to fit on a mattress, a pillow securely attached to the bottom side of the panel at a location corresponding to a headboard-side of the bed sheet portion, a pair of opposing slits, each of the slits extending from a side edge of the panel toward the axis, wherein the slits form a location where the panel is folded over itself when placed on the mattress, and a blanket portion configured to cover the bed linen portion and drape over side edges of the mattress when the panel is folded over itself. In certain embodiments, the slits are configured to separate the bed sheet portion from the blanket portion and direct tension toward the axis resulting in gripping of the mattress when the blanket portion is pulled in a direction away from the fold.

In certain embodiments, the bed linen system also includes a plurality of gussets, each gusset being securely attached to a corner of the bed sheet portion of the panel, wherein each gusset is configured to allow the bed sheet portion to envelop a corner of the mattress. The gussets may be shaped to resemble a parabolic curve and comprising a long edge and a short edge, and wherein the long edge is securely attached to the side edge of the panel and the short edge is securely attached to a headboard-side edge or a footboard-side edge of the bed sheet portion of the panel. In various embodiments, the short edge of each gusset has a length substantially equivalent to that of each slit. The bed linen system may further include a reinforcing strap fixedly attached to a corner of each gusset and extending along a side of the bed sheet portion and terminating at a lower portion of the blanket portion, and wherein the reinforcing strap is configured to enhance the tension being directed toward the axis, thereby resulting in increased gripping of the mattress when the blanket portion is pulled in a direction away from the fold. In various embodiments, the reinforcing strap also includes a pair of extensions configured for attachment to a top side of the bed sheet portion. In various embodiments, the bed linen system may also include a reinforcement fixedly attached to a second corner of each gusset, wherein the reinforced corners of each gusset form hinge points configured to facilitate removal of the linen system by a caregiver. In various embodiments, the bed linen system may also include an end cap permanently attached to a footboard-side edge of the bed sheet portion of the panel.

In various embodiments, the panel is made of a material having a thickness and strength to prevent tearing and hinder persons from creating a self-harm device. In various embodiments, the panel is made of a quilted material, such as a cotton polyester blend. In various embodiments, the bed sheet portion also includes one or more (i.e., 1, 2, 3, 4, 5, or more) flexible inserts disposed in each side and positioned to take up slack resulting from use of the system on an adjustable bed.

In certain embodiments, the bed sheet portion also includes an integrated pillow securely attached to the bottom side of the panel. The pillow includes a top layer, a bottom layer, and an underlayment, wherein the pillow is securely fastened to the panel by one or more stitches selected from the group consisting of bar-tack stitches, single stitches, double stitches, triple stitches, blind stitches, other stitches, and any combination thereof.

In another aspect, the invention provides a pillow for use with the linen system provided herein. The pillow includes a one-piece panel having a top portion, a bottom portion, and a hinge portion, wherein the top portion and bottom portion are filled with batting and subdivided into a plurality of channels by stitching, and wherein the channels of the top portion are formed perpendicular to the channels of the bottom portion such that when folded at the hinge portion, the hinge portion forms a side of the pillow. In various embodiments, each of the top portion and bottom portion contain 2, 3, or 4 channels. In various embodiments, the pillow includes a pillow case configured to contain the pillow, wherein the pillow case is sewn shut to prevent removal of the pillow therefrom.

BRIEF DESCRIPTION OF THE DRAWINGS

FIG. 2A shows alignment of the end cap. FIG. 2B shows placement and attachment of the end cap onto the linen system. FIG. 2C shows a bottom view of the linen system installed on a mattress with gussets enveloping the corners of the mattress.

FIG. 2D shows hinge points of the gusset allowing for quick removal of the linen system from the mattress.

FIG. 4A shows a perspective view from the footboard end of the mattress. FIG. 4B shows a perspective view from the bottom of the mattress.

FIG. 7A shows a top perspective view of an exemplary one-piece panel design. FIG. 7B shows exemplary gussets for integration into the linen system. FIG. 7C shows an end cap having integrated gussets. FIG. 7D shows alignment of the end cap with integrate gussets. FIG. 7E shows placement and attachment of the end cap onto the linen system.

FIG. 9A shows a cross-sectional view of the pillow. FIG. 9B shows a top perspective view showing the layers of the pillow. FIG. 9C shows the stitching points for constructing the pillow. FIG. 9D shows a one-piece pillow having a top portion, a bottom portion and a hinge portion. FIG. 9E shows the one-piece pillow of FIG. 9D folded at the hinge portion and containing a middle layer. FIG. 9F shows the one-piece pillow being inserted into a pillow case. FIG. 9G shows a completed pillow with stitching around the perimeter thereof.

DETAILED DESCRIPTION OF THE INVENTION

Figure 1:
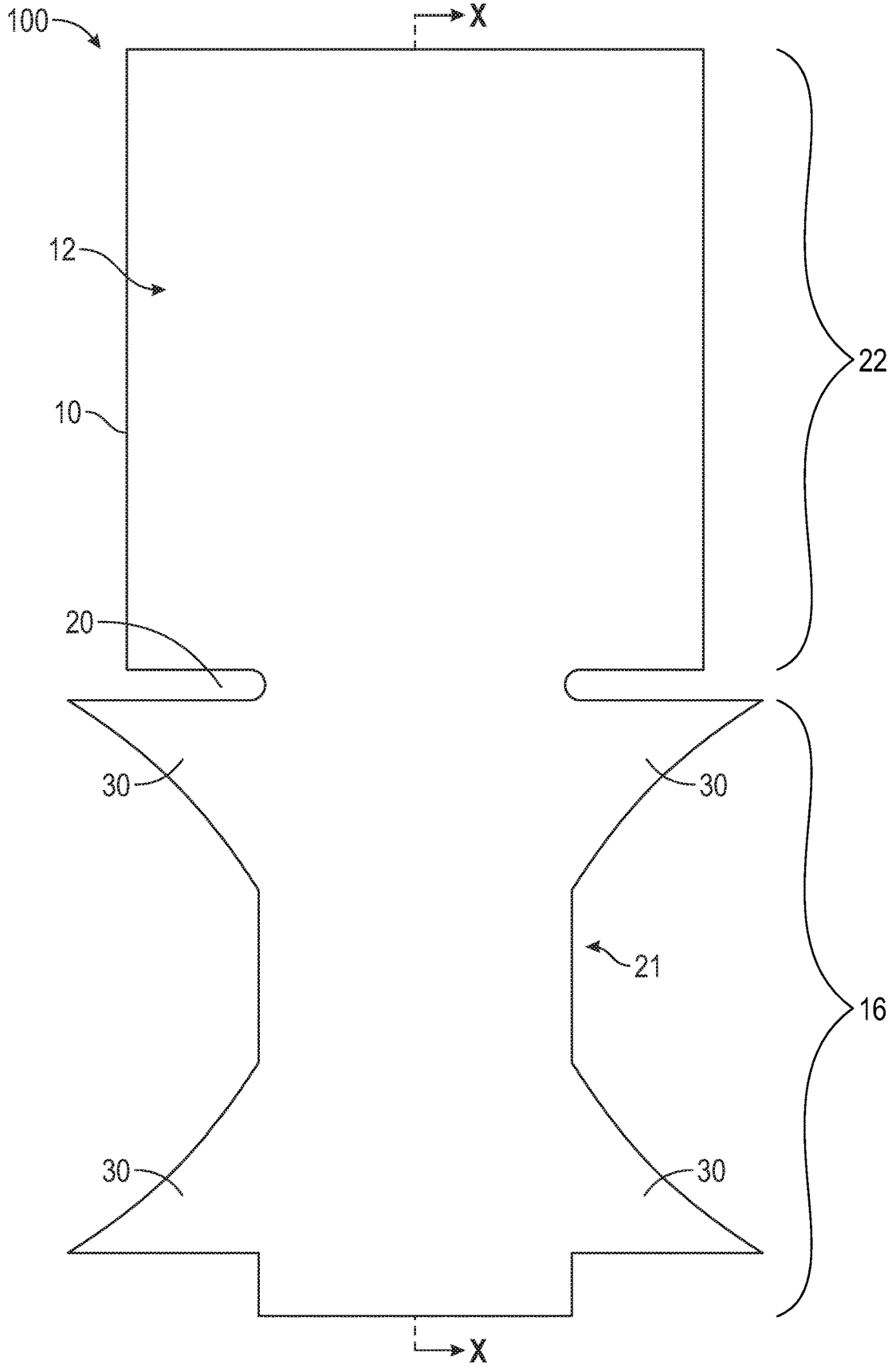
FIG. 1 is a pictorial diagram showing a top perspective view of an exemplary one-piece panel for use in forming the linen system.

The present invention provides a linen system constructed from a single piece of material for safety and comfort of the user. By providing a one-piece design, the system hinders persons from tearing the panel to create a self-harm device, and facilitates housekeeping procedures for institutions housing a plurality of persons.

Before the present systems, devices and methods are described, it is to be understood that this invention is not limited to particular systems, devices, methods, and conditions described, as such systems, devices, methods, and conditions may vary. It is also to be understood that the terminology used herein is for purposes of describing particular embodiments only, and is not intended to be limiting, since the scope of the present invention will be limited only in the appended claims.

As used in this specification and the appended claims, the singular forms "a", "an", and "the" include plural references unless the context clearly dictates otherwise. Thus, for example, references to "the method" includes one or more methods, and/or steps of the type described herein which will become apparent to those persons skilled in the art upon reading this disclosure and so forth.

The term "comprising," which is used interchangeably with "including," "containing," or "characterized by," is inclusive or open-ended language and does not exclude additional, unrecited elements or method steps. The phrase "consisting of" excludes any element, step, or ingredient not specified in the claim. The phrase "consisting essentially of" limits the scope of a claim to the specified materials or steps and those that do not materially affect the basic and novel characteristics of the claimed invention. The present disclosure contemplates embodiments of the invention compositions and methods corresponding to the scope of each of these phrases. Thus, a composition or method comprising recited elements or steps contemplates particular embodiments in which the composition or method consists essentially of or consists of those elements or steps.

Unless defined otherwise, all technical and scientific terms used herein have the same meaning as commonly understood by one of ordinary skill in the art to which this invention belongs. Although any methods and materials similar or equivalent to those described herein can be used in the practice or testing of the invention, the preferred methods and materials are now described.

Based on in-depth research, it has been found that inpatient complaints were consistent in regard to lack of sleep due to bedding. The noise and sweating that is caused by a vinyl mattress with thin sheets creates an environment that is disruptive to the normal sleep pattern. This lack of sleep makes receptiveness to treatment more difficult and can lead to a prolonged need for therapy. The present invention provides a one-piece bedding system formed from thick quilted material that is more difficult to use as a self-harm device. By bulking up the materials, a less lethal alternative to traditional sheets, pillow cases and mattress covers is provided. The use of quilted, thicker materials makes it less likely that a patient attempting to hang himself/herself will be able to generate the kind of pressure required around the carotid artery for asphyxiation. (It only takes four to five minutes of adequate pressure on the carotid artery to produce death by oxygen deprivation to the brain.)

As traditional sheets only provide a thin layer between the patient's body and the vinyl mattress, the result is a high degree of discomfort. By quilting the bottom sheet portion of the bed linen system, the invention provides a sufficient buffer between the patient's body and the mattress that allows for better heat distribution and helps in providing a good night's sleep, which in turn aids in the treatment process and overall well-being of the patient. The custom fitted bed sheet portion creates a snug fit to the mattress, thereby providing bedding that is difficult to remove but, at the same time, is still easy enough for staff to make linen changes.

Referring now to FIGS. 1-3, the invention provides a bed linen system 100. The system includes a one-piece panel 10 having a top side 12, a bottom side 14, and an axis X. The panel includes a bed sheet portion 16 configured to fit on a mattress 18, a pair of opposing slits 20, each of the slits 20 extending from a side edge 21 of the panel 10 toward the axis X. In various embodiments, the slits 20 form a location where the panel 10 may be folded over itself when placed on the mattress 18. As such, the panel 10 includes a blanket portion 22 configured to cover the bed sheet portion 16 and drape over sides 24 of the mattress 18 when the panel 10 is folded over itself.

In various embodiments, the panel 10 is made of a material having a thickness that hinders persons from creating a self-harm device. This bed linen system 100 is configured to eliminate the use of sheets and may therefore be used in place of sheets. Preferably, the panel 10 is made of a quilted material, with the quilting being configured to strengthen the material. In various embodiments, the material is a washable durable material, such as a cotton polyester blend, but other suitable materials with similar properties may be used. A quilted cotton material adds to a person's comfort and the quilted panel 10 may provide aesthetic and therapeutic value. Threads used for the quilting may be heavy polyester threads to make the bed linen system 100 tough and resistant to tearing. In various embodiments, the perimeter of the panel is provided with a plurality of stitching for added safety and comfort. Exemplary forms of stitching include, but are not limited to, bar-tack stitches, single stitches, double stitches, triple stitches, blind stitches, any other suitable types of stitching, and any combination thereof.

Integrated into the bed sheet portion 16 of the panel 10 are a plurality of gussets 30 located at the edges of the bed sheet portion 16. In various embodiments, the gussets 30 may be substantially shaped like a right triangle with the hypotenuse 31 being shaped to resemble a parabolic curve (FIG. 2C). When so formed, the longer leg 32 of the right triangle is created by folding the gusset at the edge of the bed sheet portion 16 corresponding to the left or right side of the mattress, while the shorter leg 34 of the right triangle of the gusset 30 is securely attached to the edge of the bed sheet portion 16 corresponding to the headboard-side 36 or the footboard-side 38 of the mattress 18. By minimizing the number of attachment points required to create the gussets 30, significant cost savings are realized while maintaining resistance to tearing by a patient. Referring now to FIG. 2C, bed sheet portion 16 may include four integrated gussets 30 corresponding to each corner of the mattress 18. The size and shape of each gusset 30 are instrumental in the formation of hinge points 33, which together form hinge H (FIG. 2D) to facilitate removal of the linen system 100 for cleaning and replacement by caregivers. As shown in FIG. 2D, the application of upward force at a corner of the bedsheet portion 16 allows the corresponding corner of the mattress 18 to easily be released from the linen system 100 without causing undue stress on the linen system 100 that could lead to failure and/or tearing by a patient.

Figure 2A:
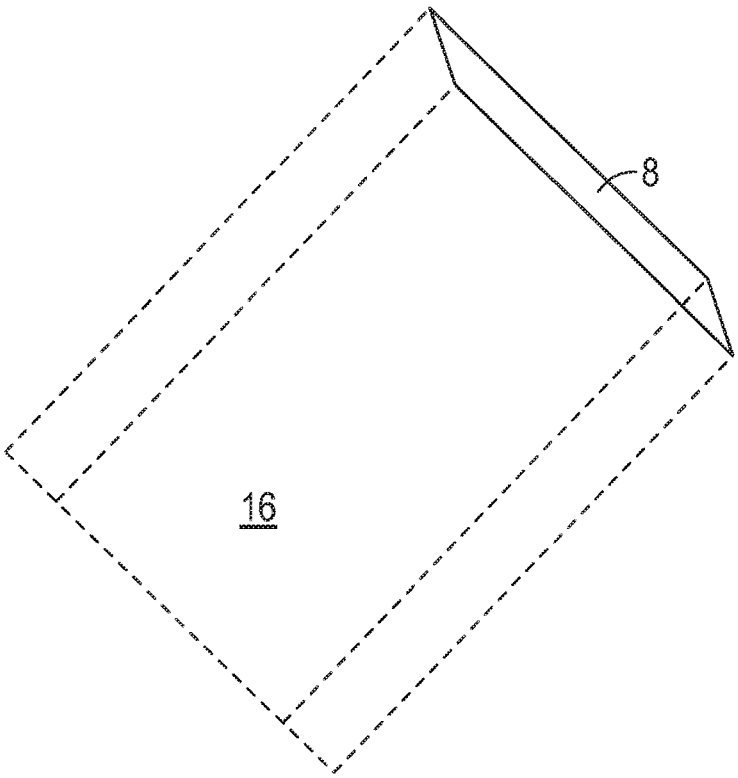
FIGS. 2A-2D are pictorial diagrams showing integration of the end cap into the linen system.
Figure 2B:
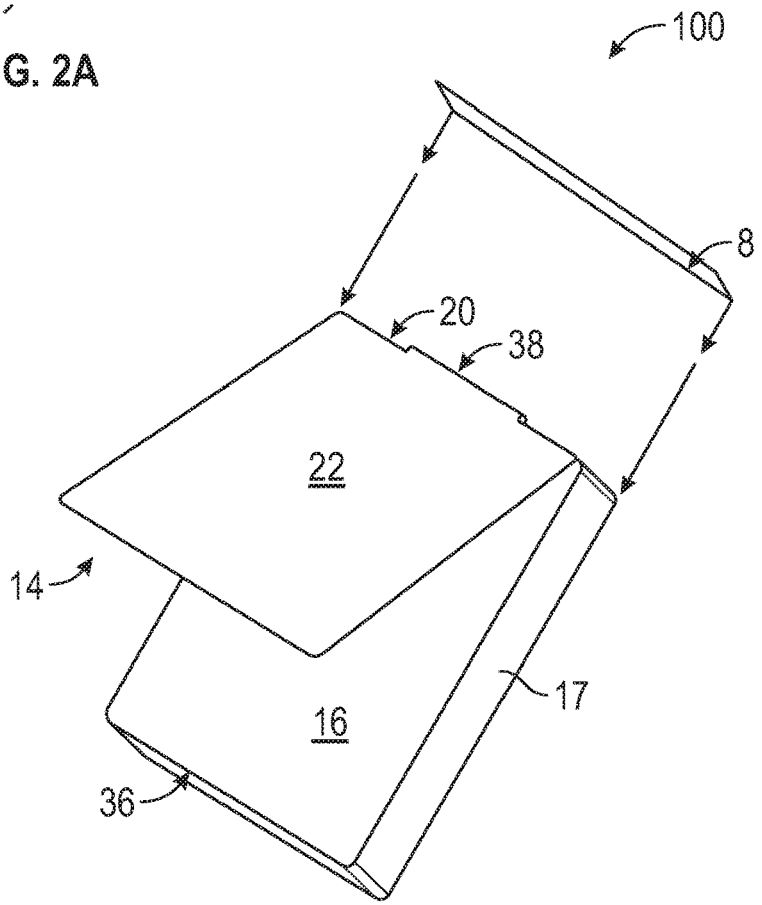
Figure 2C:
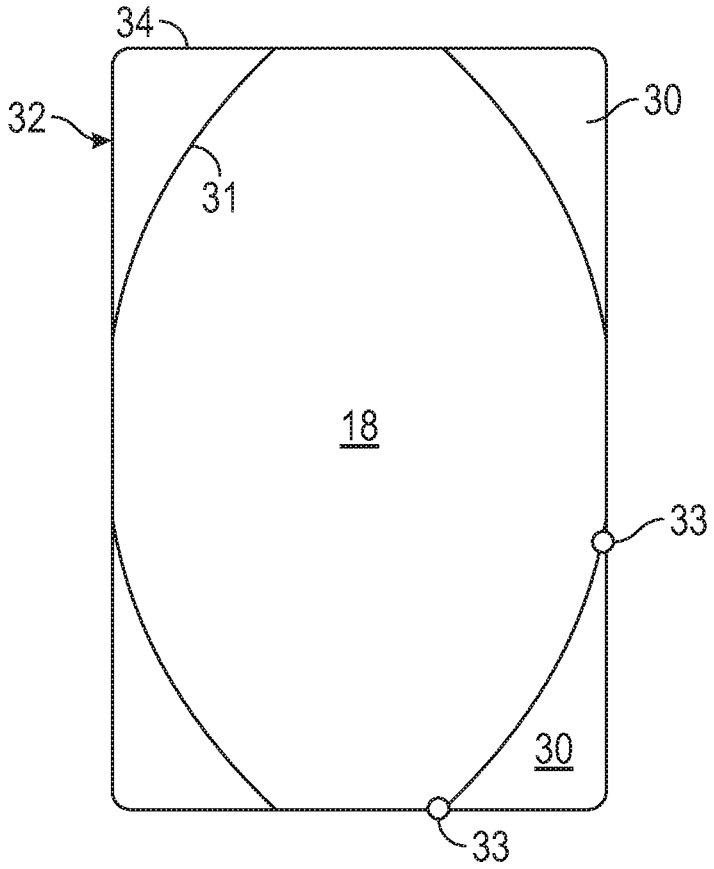
Figure 2D:
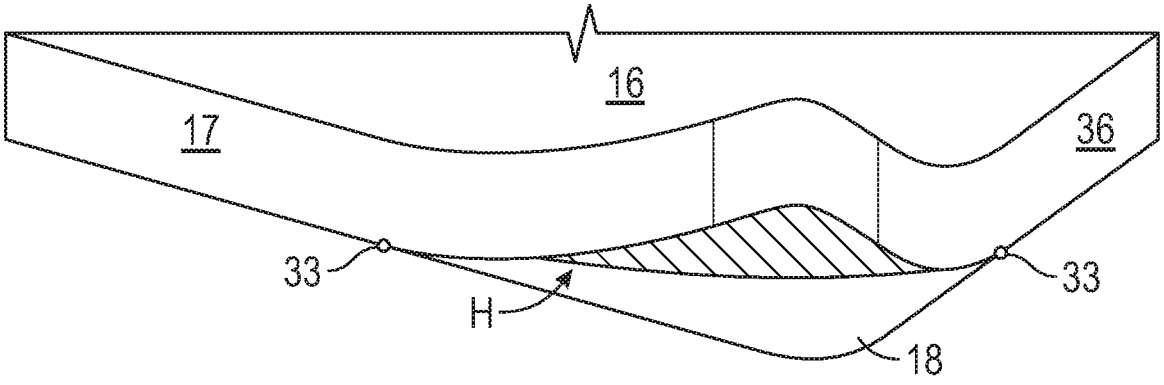
Figure 3A:
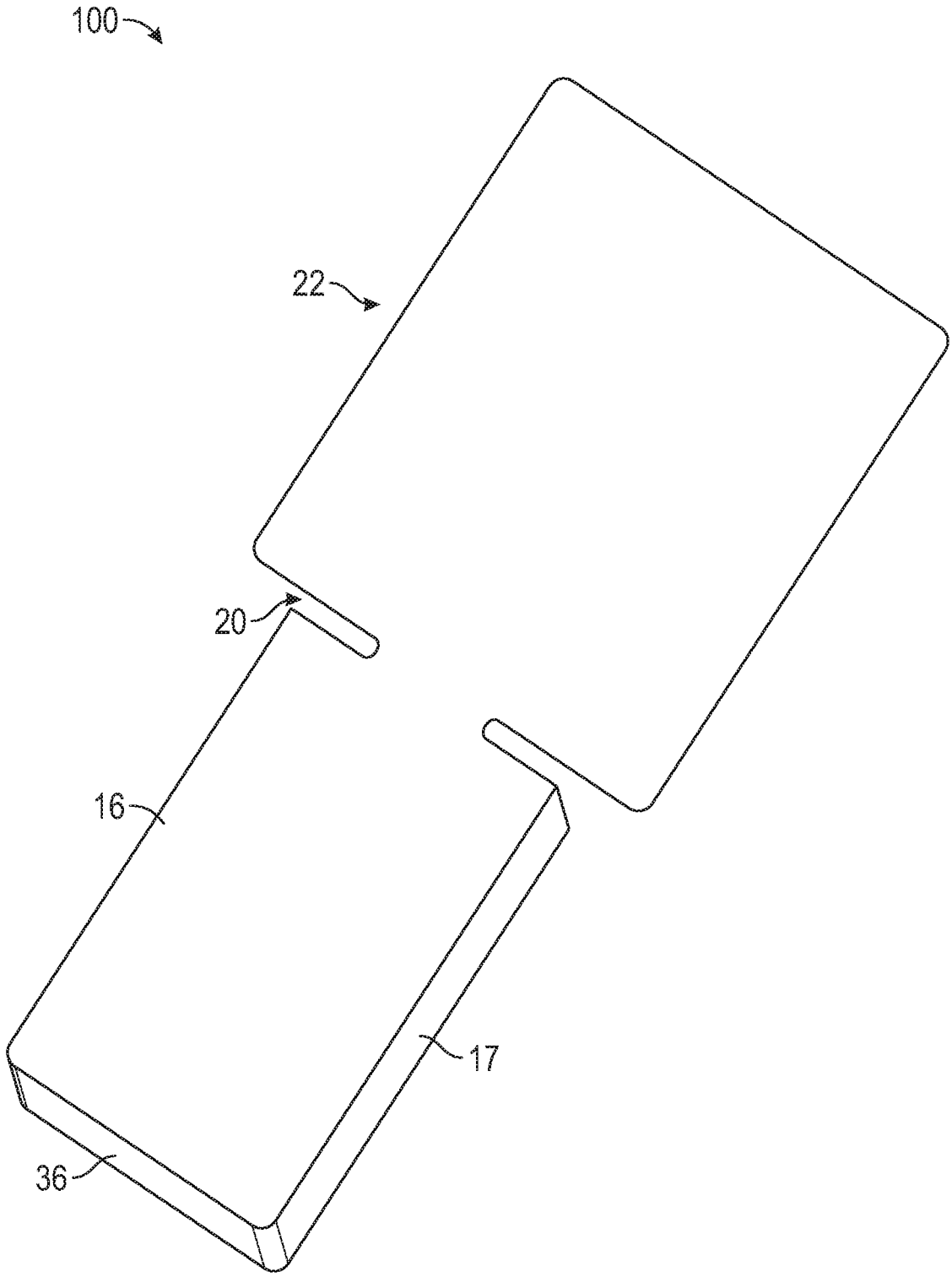
FIG. 3A is a pictorial diagram showing a top perspective view of the linen system installed on a mattress.

Referring now to FIGS. 2A and 2B, linen system 100 may further include an end cap 8 that is sized and shaped to fill a void created when folding the bedsheet portion 16 of the panel 10 to fit a mattress 18. It should be understood that end cap 8 may be formed in any shape or size required to complete bedsheet portion 16. Additionally, as discussed in greater detail below, end cap 8 provides the added benefit of reinforcing the approximate location where the panel 10 is folded over itself to form the blanket portion 22. As such, in various embodiments, end cap 8 may be positioned adjacent to slits 20.

Figure 3B:
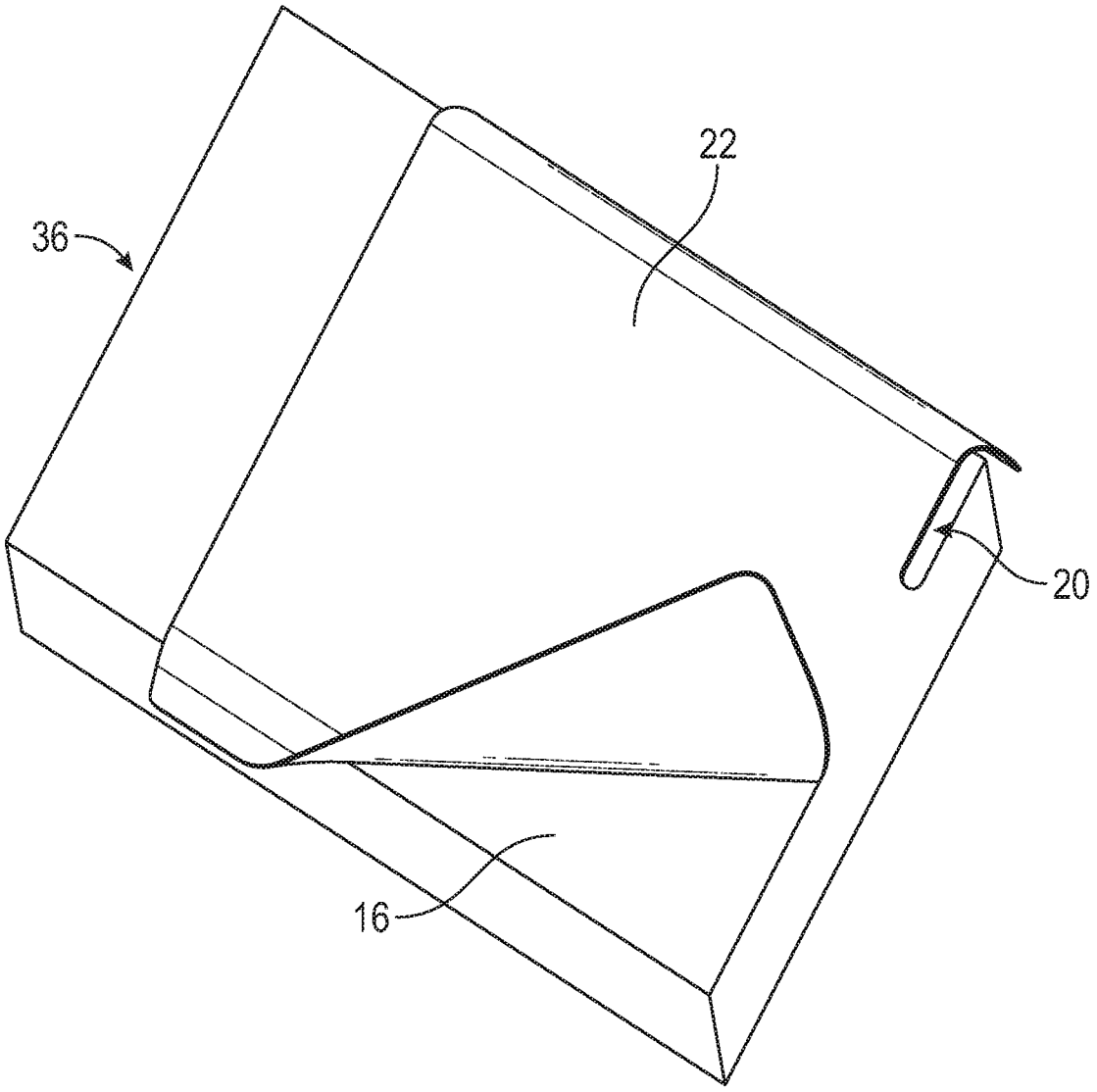
FIG. 3B is a pictorial diagram showing a top perspective view of the linen system with the panel folded over itself and showing that the slit allows a user to ventilate the foot area during use.
Figure 4A:
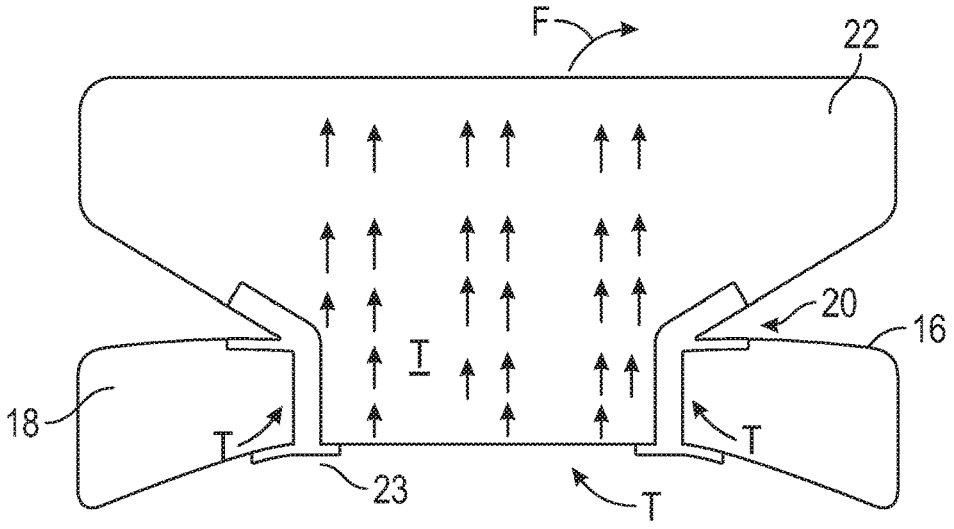
FIGS. 4A and 4B are pictorial diagrams showing the tension path created when the blanket portion of the one-piece panel is pulled by a patient.
Figure 4B:
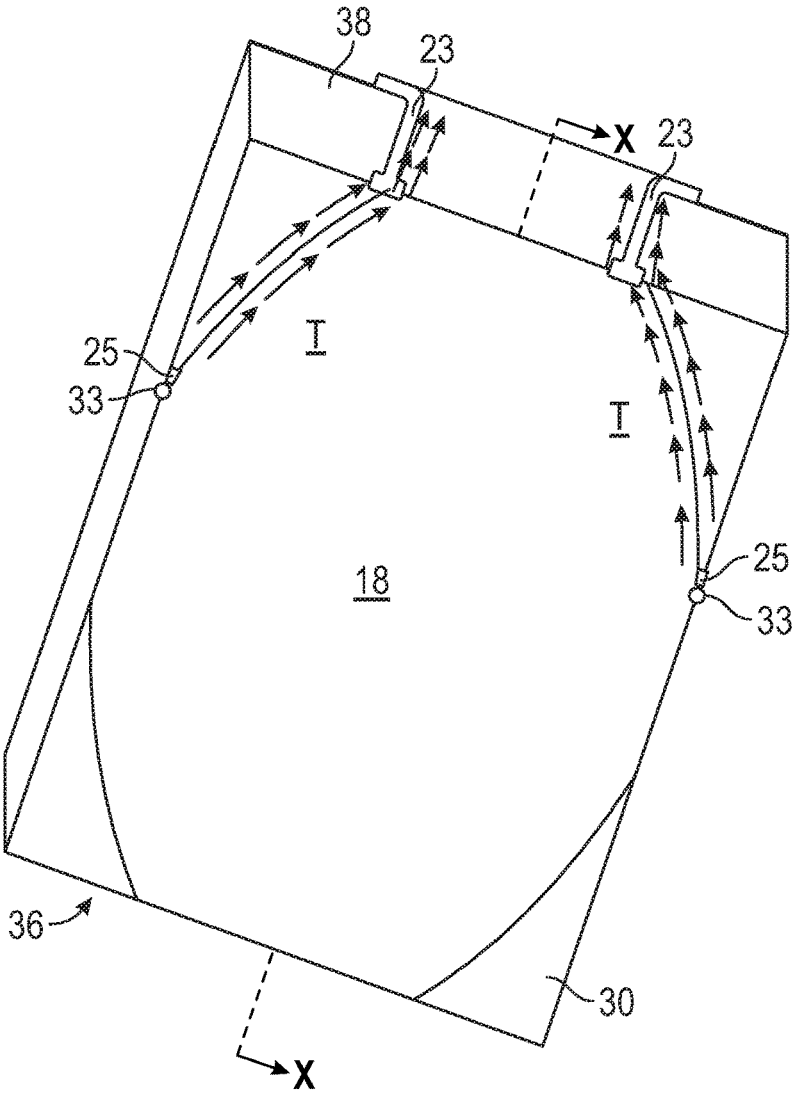

Referring now to FIGS. 3A, 3B, 4A and 4B, there is shown an exemplary linen system 100 installed on a mattress with the blanket portion 22 ready to be folded over the bedsheet portion 16. As shown in FIG. 3B, slits 20 allow a patient the freedom to adjust the positioning of the blanket portion 22 as desired to reduce the buildup of heat and sweating on the body and/or at the feet area when in use. Thus, slits 20 are also configured to allow a user to fold the blanket portion 22 toward the axis X for ventilation of the feet or body during use. As shown in FIGS. 4A and 4B, the slits 20 and gussets 30 work in conjunction to direct tension T upward and inward toward the axis X when the blanket portion 22 is pulled with a force F in a direction away from the fold, such as when pulled by a patient who suffers from self-harming or suicidal behavior and/or thoughts. The tension T serves to grip the corners of the mattress at the approximate location of the hypotenuse 31 of each gusset 30, thereby significantly reducing the ability of a patient from tearing or otherwise dismantling the linen system 100 for use in harming himself/herself.

Figure 5:
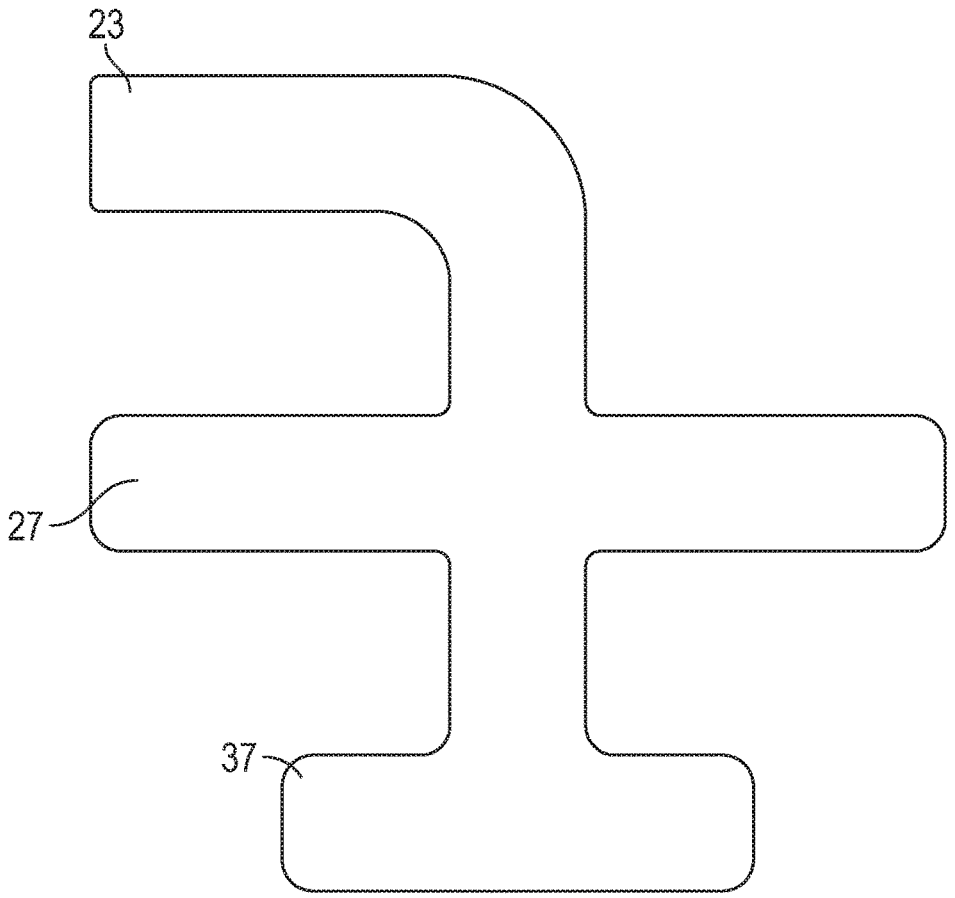
FIG. 5 is a pictorial diagram showing a perspective view of an exemplary reinforcing strap.

In various embodiments, the linen system 100 may further include a plurality of reinforcing straps 23 fixedly attached to a lower edge of the blanket portion 22 and disposed across the end cap 8 and bed sheet portion 16 that covers the footboard-side 38 of the mattress 18. In various embodiments, the reinforcing straps 23 may be permanently attached to at least one corner of a gusset 30, thereby strengthening the hinge points 33. With reference now to FIG. 5, the reinforcing straps 23 may further include a pair of extensions 27 configured to be attached to the top surface of bedsheet portion 16 in close proximity to slits 20. However, it should be understood that the reinforcing straps 23 may be of any size or shape configured to strengthen the panel 10. In certain embodiments, a first end 37 of reinforcing strap 23 may have a substantially rectangular or other suitable configuration for attachment to a lower edge of the bed sheet portion 16 (FIG. 4A). Likewise, the linen system 100 may further include reinforcements 25 disposed at the corner opposite that of reinforcing strap 23 of each gusset 30 to further enhance the strength of hinge points 33 (FIG. 4B).

Accordingly, as shown in FIGS. 4A and 4B, the reinforcing straps 23 and reinforcements 25 provide additional resistance to tearing when force F is applied to the blanket portion 22. Thus, when force F is applied to the blanket portion 22, the resultant tension applied to the mattress 18 is one that grips the footboard-side 38 corners of the mattress 18 and causes the corners to curl in a downward direction and toward the axis X of the mattress 18. In various embodiments, reinforcing straps 23 and reinforcements 25 may be made from binding tape, gross grain, woven or non-woven material, nylon or cotton straps, and/or may be formed from the same material from which the panel 10 is made. Exemplary forms of attaching reinforcing straps 23 and reinforcements 25 to the panel 10 include, but are not limited to, bar-tack stitches, single stitches, double stitches, triple stitches, blind stitches, any other suitable types of stitching, and any combination thereof.

Figure 6:
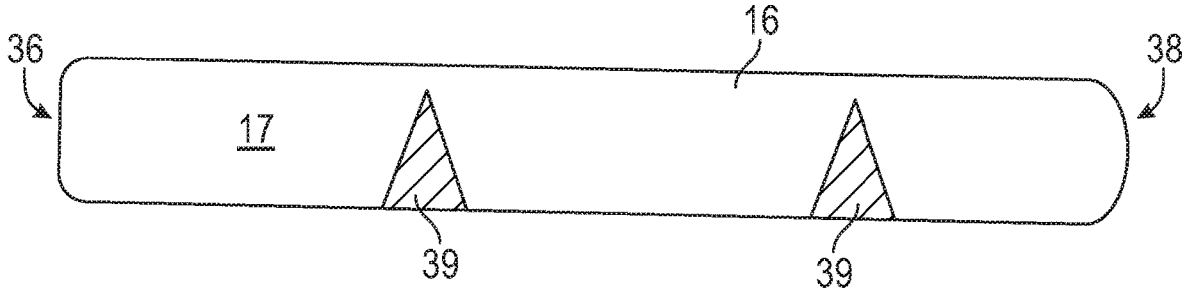
FIG. 6 is a pictorial diagram showing a side view of the mattress portion of the linen system having disposed therein flexible inserts.

As shown in FIG. 6, sides 17 of the mattress portion 16 of the panel 10 may include one or more flexible inserts 39 disposed therein. Flexible inserts 39 may thus be provided to take up slack resulting from use of the linen system 100 on an electric hospital/institutional bed having the ability to raise/lower the head portion and/or leg portion of the mattress 18. In such situations, pairs of flexible darts 39 may be disposed on opposing sides 17 and positioned at the approximate location of the folding mechanism of the bed/mattress. It should be understood that while FIG. 6 shows two flexible inserts 39, it is contemplated that each of sides 17 may include 1, 2, 3, 4, 5, or more flexible inserts 39, as necessary. In various embodiments, flexible inserts 39 are formed from an elastic/stretchable material and are permanently attached (e.g., sewn) into the sides 17 so as to prevent intentional tearing thereof. In various embodiments, the flexible inserts 39 may be formed in any shape, such as a triangle, quarter-moon or half-moon, to accommodate any adjustable bed mechanism.

Figure 7A:
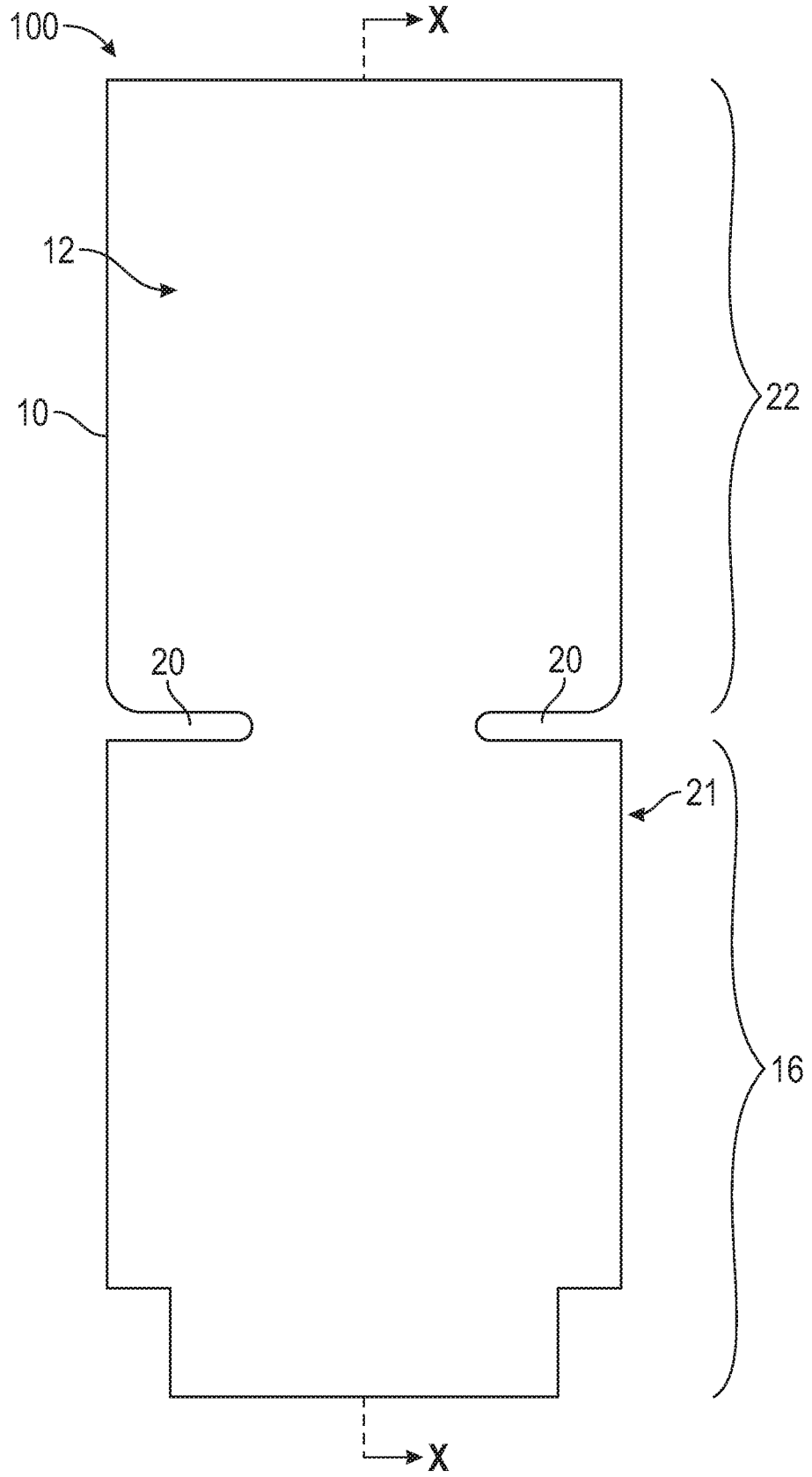
FIGS. 7A-7E are pictorial diagrams showing an exemplary one-piece panel for use in forming the linen system.
Figure 7B:
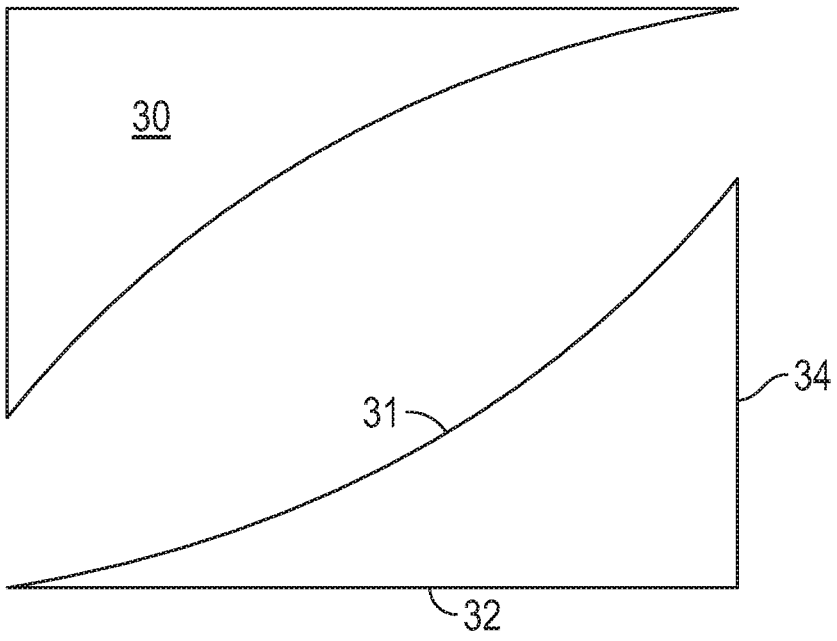
Figure 7C:
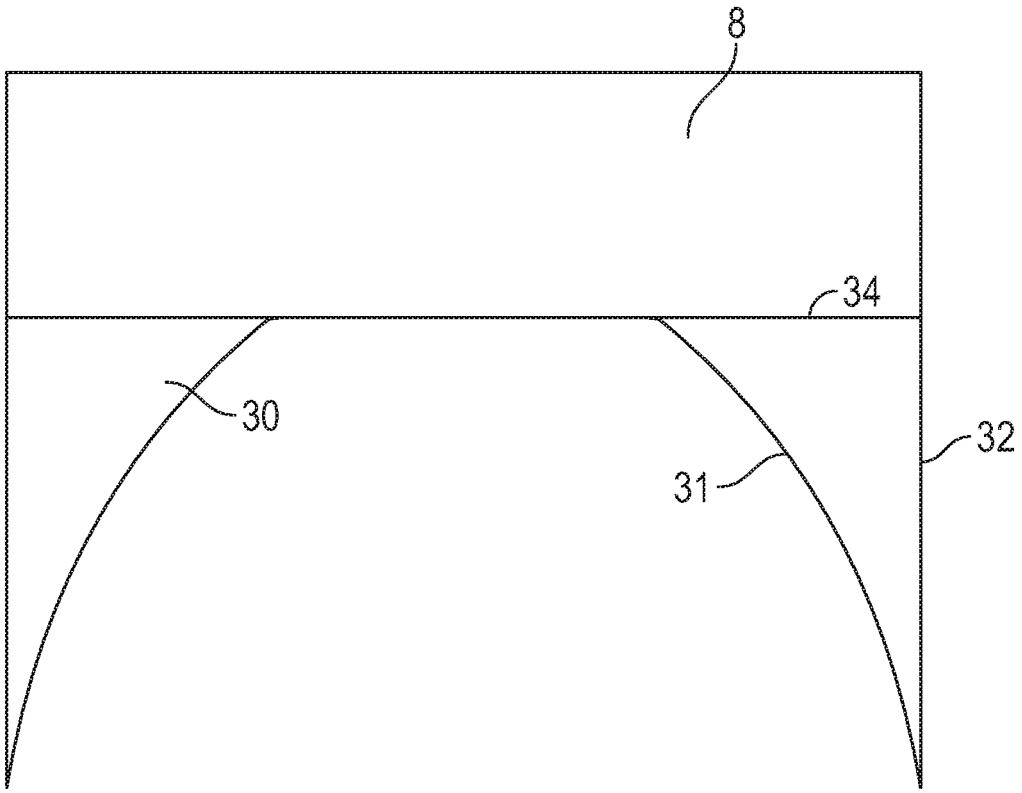
Figure 7D:
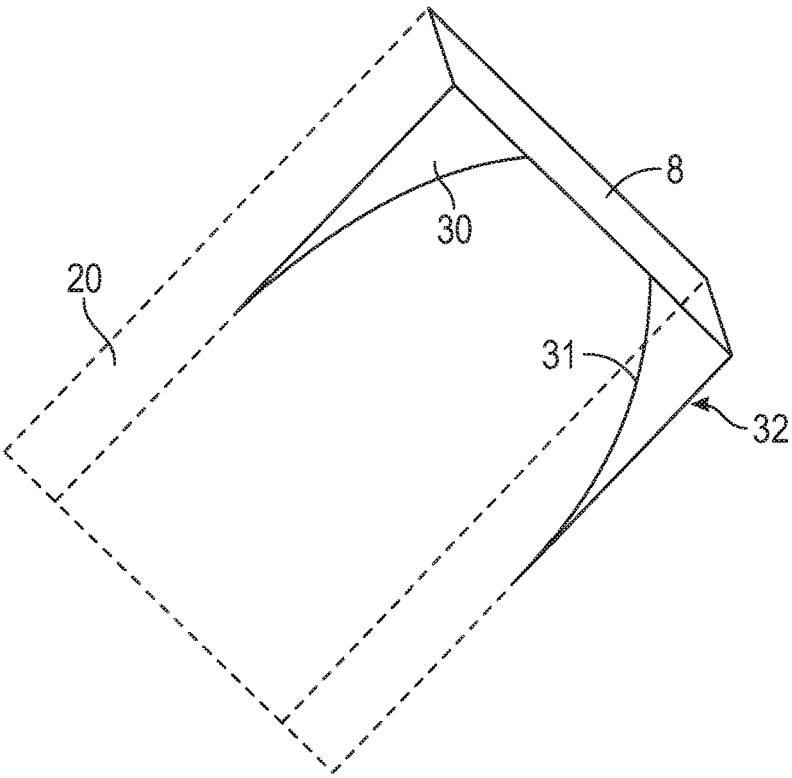
Figure 7E:
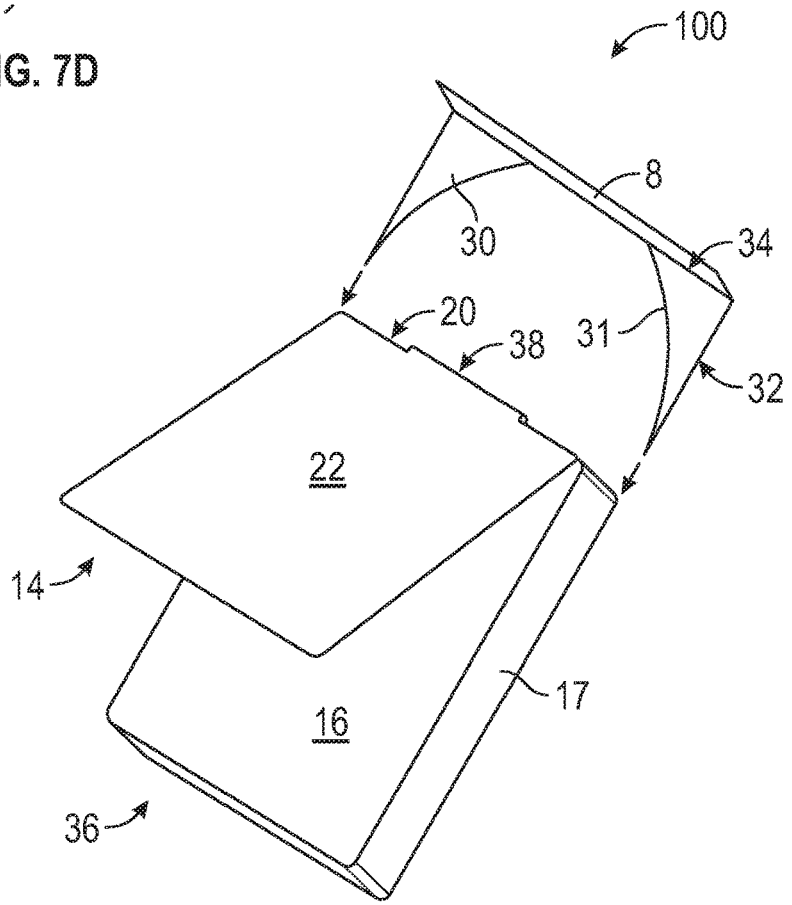

Referring now to FIGS. 7A-7E, there is shown an alternative embodiment of the linen system 100. In this embodiment, elements identical to those shown in FIG. 1 are labeled as such, and therefore only the differences will be discussed herein. In this embodiment, the plurality of gussets 30 are formed separately from the panel 10 and permanently attached to the respective edges 21 of the bedsheet portion 16. In various embodiments end cap 8 may include a pair of integral gussets 30, as shown in FIG. 7C, while a pair of gussets 30 are provided separately for the headboard-side 36 of the mattress (FIG. 7B). Thus, once the bed sheet portion 16 has been securely sewn to conform to the shape of a mattress 18, the gussets 30 may be securely sewn to form corners that envelop the corners of the mattress 18. In certain embodiments, an edge of each gusset 30 that corresponds to the slits 20 may be angled away from slits 20 to provide added tension toward the mattress and reduce the ability to remove the linen system 100 therefrom.

Accordingly, use of linen system 100 provides stress-free linen changes by those charged with maintaining bedding of patients. As a result of the gussets 30 being placed under each corner of the mattress 18, while allowing bed sheet portion 16 to drape over the sides of the mattress 18, a hinge H is formed along the hypotenuse of the gusset 30 by which the bedding may be removed with correct application of force, thereby reducing tension and/or stress to the seams of the linen system 100 (FIG. 2D). In various embodiments, the sides 17 of the bed sheet portion 16 do not fold under the mattress 18, as is the case with most conventional fitted sheets.

Any of the above-discussed embodiments of the linen system 100 may be made formed from a panel 10 that itself is formed from two separate pieces of similarly-shaped material that are securely fastened to each other around the entire perimeter thereof to form a single piece of material. In various embodiments, the strength of the linen system 100 may be enhanced by inclusion of additional stitching at the bottom edge of the blanket portion 22 at the approximate location where the panel 10 folds over itself. In various embodiments, this corresponding area of panel 10 may be covered with binding tape and fastened using one or more of bar-tack stitches, single stitches, double stitches, triple stitches, blind stitches, and any combination thereof.

Figure 8A:
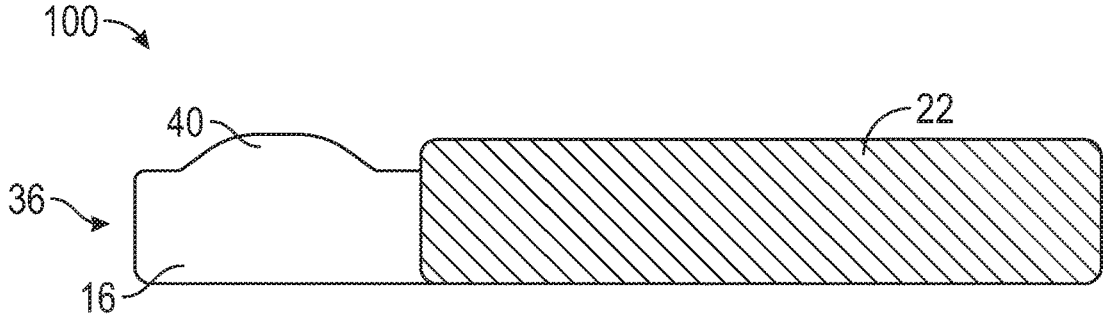
FIGS. 8A-8C are pictorial diagrams showing side views of the linen system with integrated pillow (FIG. 8A), construction of the integrated pillow (FIG. 8B), and stitching points for attachment to the panel (FIG. 8C).
Figure 8B:
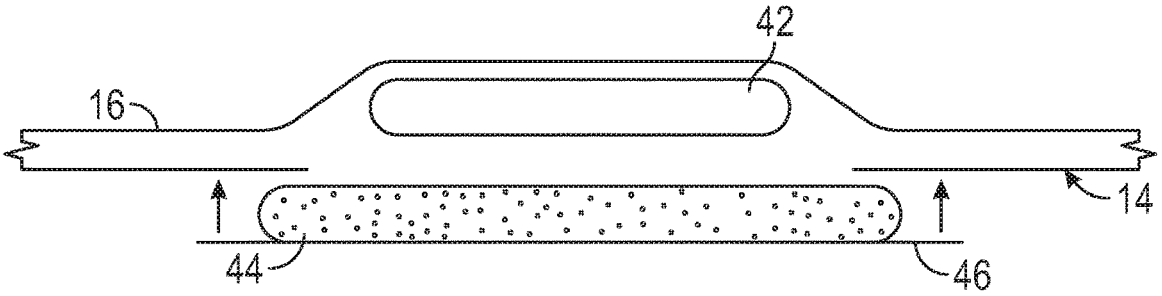
Figure 8C:
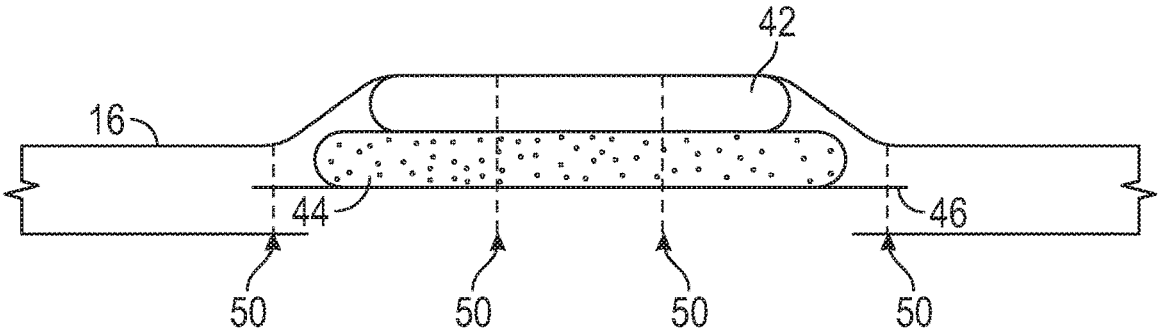

As shown in FIGS. 8A-8C, the bed linen system 100, may further include an integrated pillow 40. This creates a complete one-piece linen solution while eliminating the opportunity for a patient to use of a separate pillow to cause harm to himself/herself. FIG. 8B shows construction of an exemplary embodiment of the integrated pillow 40. Thus, in various embodiments, the pillow 40 may be formed from a top layer 42 and a bottom layer 44, where the top layer 42 forms the upper half of the pillow 40. The top layer 42 and bottom layer 44 may be formed from any batting material that would be sufficient for such use. In various embodiments, the pillow 40 may further include an underlayment 46, which serves to securely fasten the pillow 40 to the bottom surface of the bed sheet portion 16 of the panel. In various embodiments, the pillow may include an internal insert containing water resistant polyester or form material. The insert may be formed from any pliable plastic material (e.g., Tyvek, DuPont) to create a water barrier. In various embodiments, the pillow 40 is stitched around its perimeter, and may further be stitched at various positions 50 throughout the pillow 40 to prevent bunching of the batting material disposed therein. FIG. 8C shows exemplary positioning of the stitching, which may include one or more of bar tack stitching, single stitching, blind stitching, or any other common stitching.

Figure 9A:
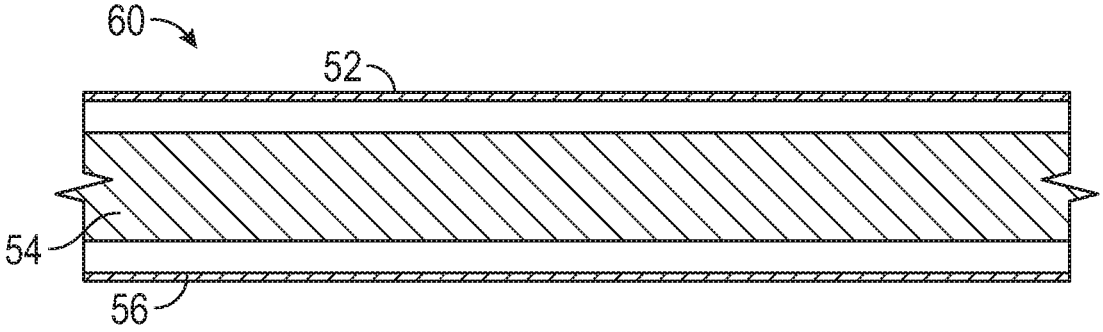
FIGS. 9A-9G are pictorial diagrams showing an exemplary one-piece pillow.
Figure 9B:
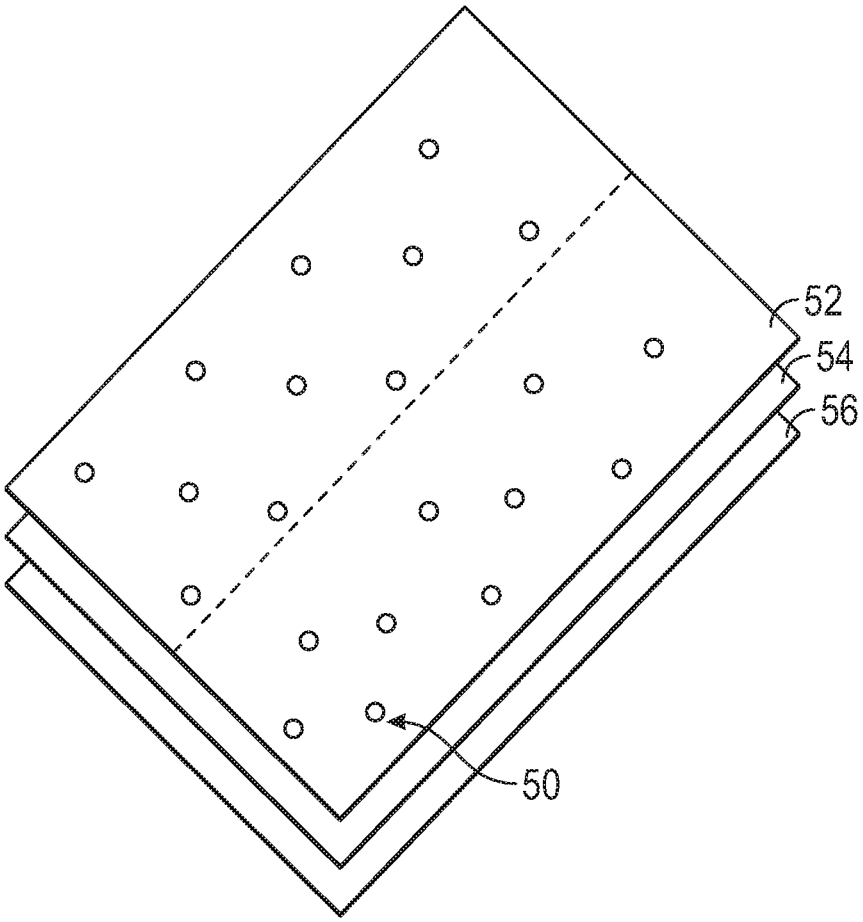
Figure 9C:
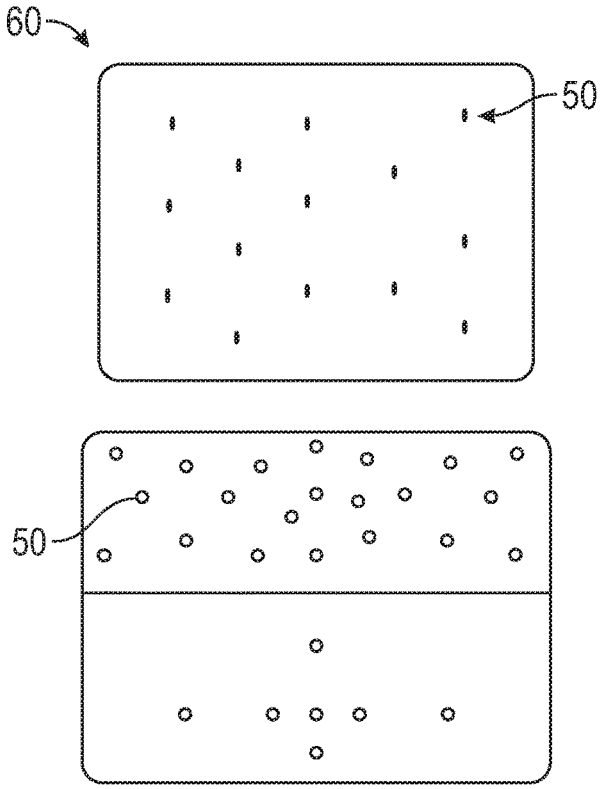

Referring now to the FIGS. 9A-9G, the invention also provides a one-piece pillow 60 of substantially rectangular shape designed to allow to the whole item to be used and washed without a pillow case. FIG. 9A shows a cross-sectional view of the pillow's internals. The top layer 52 may be formed from a cloth fabric, such as cotton, polyester, or any other suitable material. The middle layer 54 is a batting material to create thickness and fluff. The bottom layer 56 is a mesh material configured to keep the batting material in place, yet allowing moisture and heat to pass through. As shown in FIG. 9B, each of the layers of the pillow 60 are substantially aligned with one another and may be folded in half along a folding line to create a substantially rectangular shape. As shown in FIG. 9C, once aligned, the multiple layers forming pillow 60 may be stitched at a plurality of stitching points 50 to prevent gathering or clumping of the batting material. Exemplary stitches useful at stitching points 50 include, but are not limited to, bar tack stitching, single stitching, blind stitching or any other common stitching suitable to keep the batting in place.

Figure 9D:
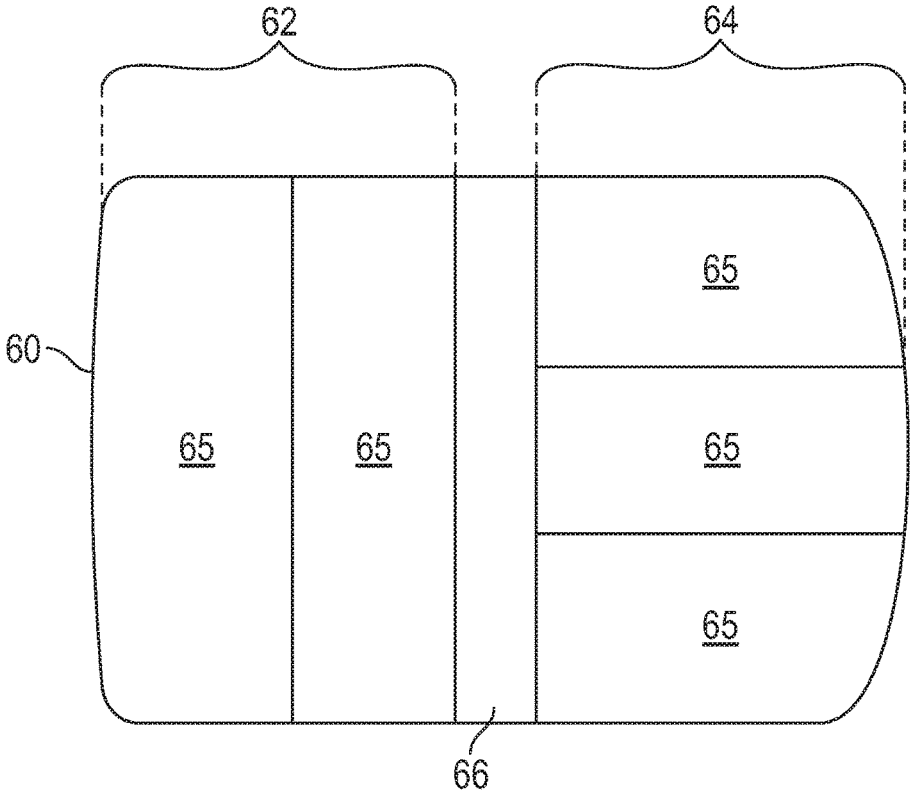
Figure 9E:
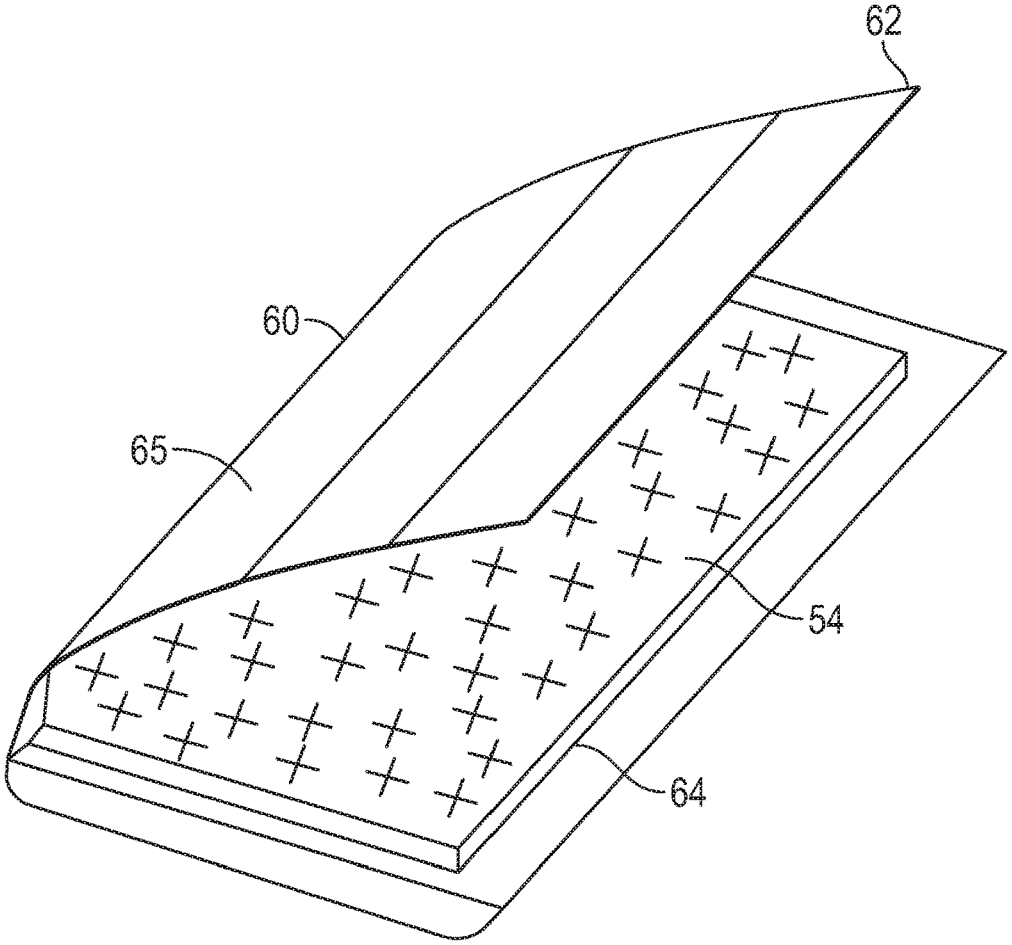

As shown in FIG. 9D, pillow 60 may be formed as a single unit having a top portion 62 and a bottom portion 64, with a hinge portion 66 separating the top portion 62 and bottom portion 64. As described above, the single unit may be formed from two layers of cloth such as cotton, polyester, or any other suitable material, and sewn together to form the single unit. Batting material may therefore be provided within each of the top portion 62 and bottom portion 64, but is absent from the hinge portion 66 to allow the single unit to be folded over itself. Thus, when top portion 62 is folded over the bottom portion 64, hinge portion 66 forms a side of the pillow 60. In various embodiments, an additional middle layer 54 may be provided between top portion 62 and bottom portion 64 for added thickness and fluff (FIG. 9E). In various embodiments, top portion 62 and bottom portion 64 are sub-divided into a plurality of channels 65 (FIG. 9D), each channel 65 being separated by stitching to prevent gathering or clumping of the batting material within each of the top portion 62 and bottom portion 64. In various embodiments, each of top portion 62 and bottom portion 64 may be sub-divided into 2, 3, 4, or 5 channels. In various embodiments, the sub-divisions of each of top portion 62 and bottom portion 64 may be formed in the same direction or perpendicular to one another to further increase thickness, fluff, and resistance to clumping.

Figure 9F:
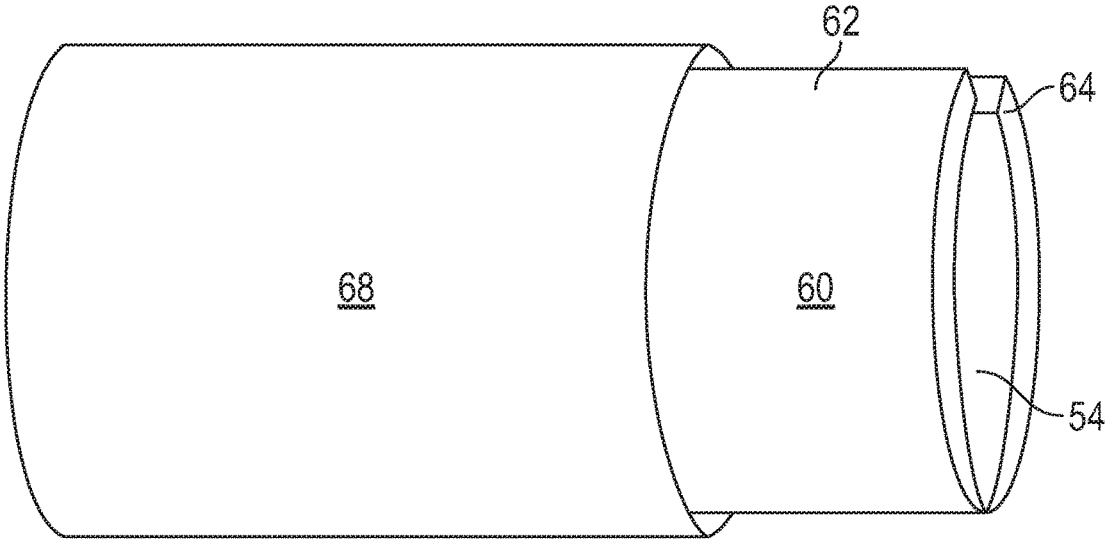
Figure 9G:
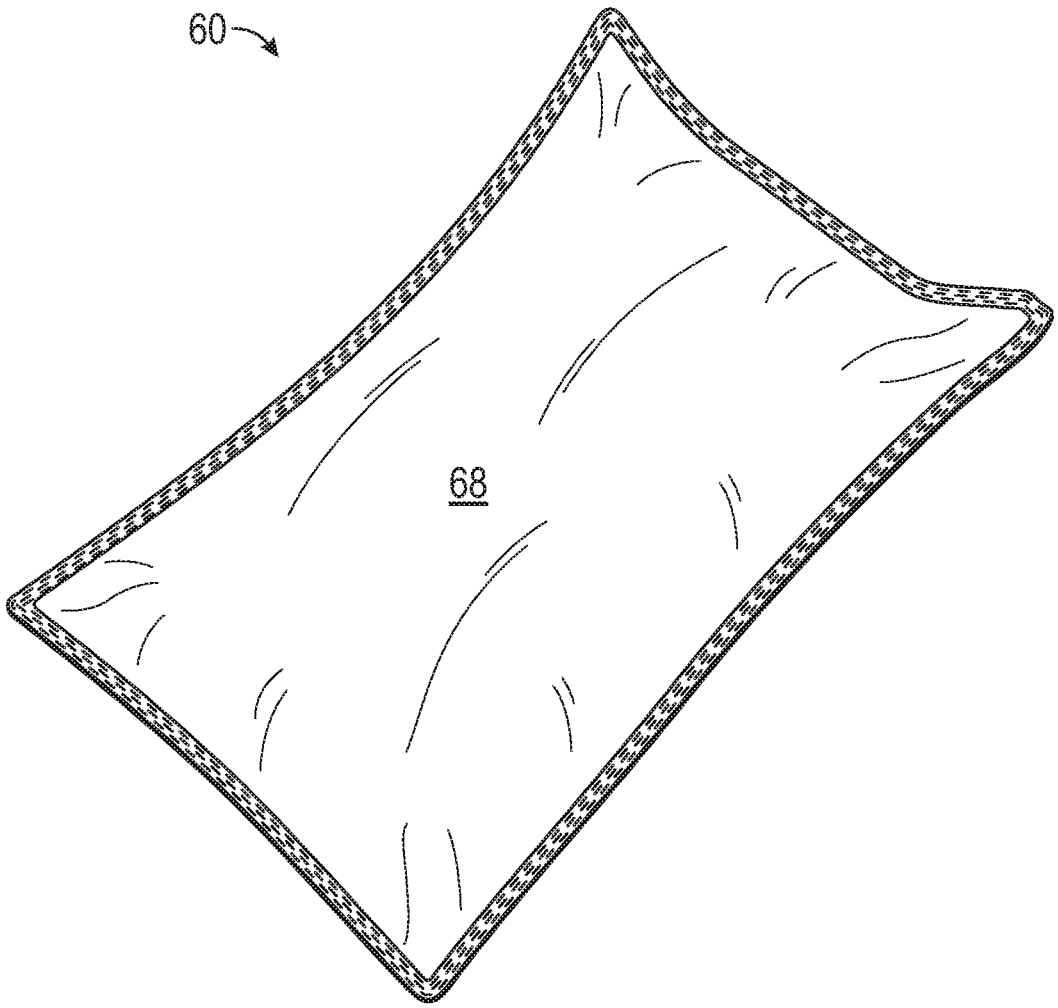

As the entire pillow 60 is washable, the pillow does not need a pillowcase, thereby eliminating the possibility of being used to cause self-harm to a patient. However, in certain embodiments, the entire pillow is provided in a pillow case 68, which is sewn shut to prevent removal thereof (FIG. 9F). In various embodiments, a plurality (i.e., 2, 3, 4, 5, 6 or more) rows of stitching are provided around the perimeter of the pillow 60 for security. As above, exemplary stitches useful in sealing the pillow case 68 include, but are not limited to, bar tack stitching, single stitching, blind stitching or any other common stitching suitable to permanently close the pillow case 68.

Additionally, as the pillow may be quilted and/or otherwise formed from the same material as that of panel 10, the pillow is difficult to tear open to use for suffocation. Further, the two folded pillow portions with integrated channels 65 and/or stitching 50 create a clumping-resistant stuffing that will stand up to numerous uses and washings while retaining sufficient fluff such that the pillow 60 has a thickness that is substantially equal to the thickness of typical pillows. Thus, pillow 60 may be used in conjunction with linen system 100 in hospitals or institutions that require frequent washings of pillows for infection control.

Although the invention has been described with reference to the above disclosure, it will be understood that modifications and variations are encompassed within the spirit and scope of the invention. Accordingly, the invention is limited only by the following claims.

What is claimed is:

1. A bed linen system comprising a one-piece panel having a top side, a bottom side, and an axis, the panel comprising:

(a) a bed sheet portion configured to fit on a mattress;

(b) a pair of opposing slits, each of the slits extending from a side edge of the panel toward the axis, wherein the slits form a location where the panel is folded over itself forming a fold when placed on the mattress;

(c) a blanket portion configured to cover the bed sheet portion and drape over side edges of the mattress when the panel is folded over itself; and (d) a reinforcing strap fixedly extending along a side of the bed sheet portion and terminating at a lower edge of the blanket portion, and wherein the reinforcing strap is configured to enhance the tension being directed toward the axis, thereby resulting in increased gripping of the mattress when the blanket portion is pulled in a direction away from the fold;

wherein the slits are configured to separate the bed sheet portion from the blanket portion and direct tension toward the axis resulting in gripping of the mattress when the blanket portion is pulled in a direction away from the fold.

2. The bed linen system of claim 1, further comprising a plurality of gussets, wherein a short edge of each gusset has a length substantially equivalent to that of each slit.

3. The bed linen system of claim 2, wherein each reinforcing strap is fixedly attached to a corner of each gusset.

4. The bed linen system of claim 1, wherein the reinforcing strap further comprises a pair of extensions configured for attachment to a top side of the bed sheet portion.

5. The bed linen system of claim 3, further comprising a reinforcement fixedly attached to a second corner of each gusset, wherein the reinforced corners of each gusset form hinge points configured to facilitate removal of the linen system by a caregiver.

6. The bed linen system of claim 5, wherein each of the reinforcing strap and reinforcement are made from a material independently selected from the group consisting of binding tape, gross grain, woven or non-woven material, nylon, cotton, cotton polyester blend, or any combination thereof.

7. The bed linen system of claim 1, further comprising an end cap permanently attached to a footboard-side edge of the bed sheet portion of the panel.

8. The bed linen system of claim 1, wherein the slits are further configured to allow a user to fold the blanket portion toward the axis for ventilation during use.

9. The bed linen system of claim 8, wherein the panel is made of a quilted material.

10. The bed linen system of claim 9, wherein the material is a cotton polyester blend.

11. The bed linen system of claim 1, wherein the bed sheet portion further comprises one or more flexible inserts disposed in each side thereof and positioned to take up slack resulting from use of the system on an adjustable bed.

12. The bed linen system of claim 11, wherein the bed sheet portion comprises two flexible inserts disposed in each side.

13. The bed linen system of claim 1, wherein the bed sheet portion further comprises an integrated pillow securely attached to the bottom side of the panel.

14. The bed linen system of claim 13, wherein the pillow comprises a top layer, a bottom layer, and an underlayment, wherein the pillow is securely fastened to the panel by one or more stitches selected from the group consisting of bar-tack stitches, single stitches, double stitches, triple stitches, blind stitches, other stitches, and any combination thereof.

15. The bed linen system of claim 14, wherein the underlayment is made of the same material from which the panel is made.

16. The bed linen system of claim 14, wherein the stitches are positioned around a perimeter of the pillow and at predetermined locations through the pillow.

17. A bed linen system comprising a one-piece panel having a top side, a bottom side and an axis, the panel comprising:

(a) a bed sheet portion configured to fit on a mattress;

(b) a pillow securely attached to the bottom side of the panel at a location corresponding to a headboard-side of the bed sheet portion;

(c) a pair of opposing slits, each of the slits extending from a side edge of the panel toward the axis, wherein the slits form a location where the panel is folded over itself forming a fold when placed on the mattress; and (d) a blanket portion configured to cover the bed sheet portion and drape over side edges of the mattress when the panel is folded over itself; and (e) a reinforcing strap fixedly extending along a side of the bed sheet portion and terminating at a lower edge of the blanket portion, wherein the reinforcing strap is configured to enhance the tension being directed toward the axis, thereby resulting in increased gripping of the mattress when the blanket portion is pulled in a direction away from the fold, wherein the slits are configured to separate the bed sheet portion from the blanket portion and together with the reinforcing strap direct tension toward the axis resulting in gripping of the mattress when the blanket portion is pulled in a direction away from the fold.

18. The bed linen system of claim 17, further comprising a plurality of gussets, wherein a short edge of each gusset has a length substantially equivalent to that of each slit.

19. The bed linen system of claim 18, wherein each reinforcing strap is fixedly attached to a corner of each gusset.

20. The bed linen system of claim 17, wherein the bed sheet portion further comprises an integrated pillow securely attached to the bottom side of the panel.

* * * * *